US009414478B2

(12) United States Patent
Schultz et al.

(10) Patent No.: US 9,414,478 B2
(45) Date of Patent: Aug. 9, 2016

(54) SELF-TUNED DIELECTRIC BARRIER DISCHARGE

(71) Applicant: International Technology Center, Raleigh, NC (US)

(72) Inventors: Brian D. Schultz, Santa Barbara, CA (US); William M. Hooke, Chapel Hill, NC (US); Michael J. Kelly, Raleigh, NC (US)

(73) Assignee: INTERNATIONAL TECHNOLOGY CENTER, Raleigh, NC (US)

( * ) Notice: Subject to any disclaimer, the term of this patent is extended or adjusted under 35 U.S.C. 154(b) by 189 days.

(21) Appl. No.: 14/096,128

(22) Filed: Dec. 4, 2013

(65) Prior Publication Data

US 2014/0197732 A1 Jul. 17, 2014

Related U.S. Application Data

(63) Continuation of application No. PCT/US2012/041103, filed on Jun. 6, 2012.

(60) Provisional application No. 61/494,201, filed on Jun. 7, 2011.

(51) Int. Cl.
*H05H 1/24* (2006.01)
*H05H 1/46* (2006.01)

(52) U.S. Cl.
CPC ..... *H05H 1/2406* (2013.01); *H05H 1/2475* (2013.01); *H05H 2001/2412* (2013.01); *H05H 2001/4682* (2013.01)

(58) Field of Classification Search
None
See application file for complete search history.

(56) References Cited

U.S. PATENT DOCUMENTS 4,317,068 A * 2/1982 Ward ..... H01T 13/50 123/169 MG
4,365,186 A * 12/1982 Gerry ..... F02P 3/01 123/169 MG
7,615,931 B2 * 11/2009 Hooke ..... A61L 2/0011 118/723 E
7,615,933 B2 * 11/2009 Hooke ..... A61L 2/0011 315/209 R (Continued)

OTHER PUBLICATIONS

Notification of Transmittal of the International Search Report and the Written Opinion of the International Searching Authority, or the Declaration: International Application No. PCT/US2012/041103: International Filing Date: Jun. 6, 2012. (Form PCT/ISA 210, 220, 237).

*Primary Examiner* — Douglas W Owens
*Assistant Examiner* — Srinivas Sathiraju
(74) *Attorney, Agent, or Firm* — Miller Patent Services; Jerry A. Miller

(57) ABSTRACT

A plasma generating system. A pair of electrodes are spaced apart by an electrode gap. A source of a gas adapted to place the gas in the electrode gap. A power generating circuit is coupled to the electrodes to generate an electric field across the electrodes so as to initiate a plasma discharge within the electrode gap. The power generating circuit has adequate capacity to maintain a sufficient electric field across the gap during the plasma discharge to allow a plasma impedance to self-tune to the plasma generating system. This abstract is not to be considered limiting, since other embodiments may deviate from the features described in this abstract.

28 Claims, 9 Drawing Sheets

(56) References Cited

U.S. PATENT DOCUMENTS 7,791,281 B2 * 9/2010 Aldea ..... H01J 37/32174 118/723 E
7,969,095 B2 * 6/2011 De Vries ..... H01J 37/32174 118/723 E
8,084,947 B2 * 12/2011 Hooke ..... A61L 2/0011 118/723 E
8,344,627 B1 * 1/2013 Hooke ..... A61L 2/0011 118/723 E
9,095,834 B2 * 8/2015 Byrne ..... H01J 37/32366
9,131,595 B2 * 9/2015 Creyghton ..... H05H 1/2406
2006/0244386 A1 * 11/2006 Hooke ..... A61L 2/0011 315/111.21
2008/0106206 A1 * 5/2008 Hooke ..... A61L 2/0011 315/111.21
2009/0200948 A1 * 8/2009 Selwyn ..... H01J 37/32082 315/111.21
2009/0297404 A1 * 12/2009 Shannon ..... H01J 37/32082 422/108
2010/0079073 A1 * 4/2010 Hooke ..... A61L 2/0011 315/111.21
2010/0175987 A1 * 7/2010 Creyghton ..... H05H 1/2406 204/164

* cited by examiner

SELF-TUNED DIELECTRIC BARRIER DISCHARGE

CROSS REFERENCE TO RELATED DOCUMENTS

This application is a continuation of PCT/US2012/041103, which claims priority benefit of U.S. Provisional Patent Application 61/494,201 filed Jun. 7, 2011 which are hereby incorporated by reference. This application is also related to U.S. Pat. Nos. 7,615,931, 7,615,933, and 8,084,947 to Hooke et al. which are also hereby incorporated by reference.

COPYRIGHT AND TRADEMARK NOTICE

A portion of the disclosure of this patent document contains material which is subject to copyright protection. The copyright owner has no objection to the facsimile reproduction of the patent document or the patent disclosure, as it appears in the Patent and Trademark Office patent file or records, but otherwise reserves all copyright rights whatsoever. Trademarks are the property of their respective owners.

BACKGROUND

Atmospheric pressure dielectric barrier discharges are most often energetically weak, generating maximum power densities on the order of only a few watts per square centimeter per pulse cycle.

BRIEF DESCRIPTION OF THE DRAWINGS

Certain illustrative embodiments illustrating organization and method of operation, together with objects and advantages may be best understood by reference to the detailed description that follows taken in conjunction with the accompanying drawings in which.

DETAILED DESCRIPTION

Figure 1:
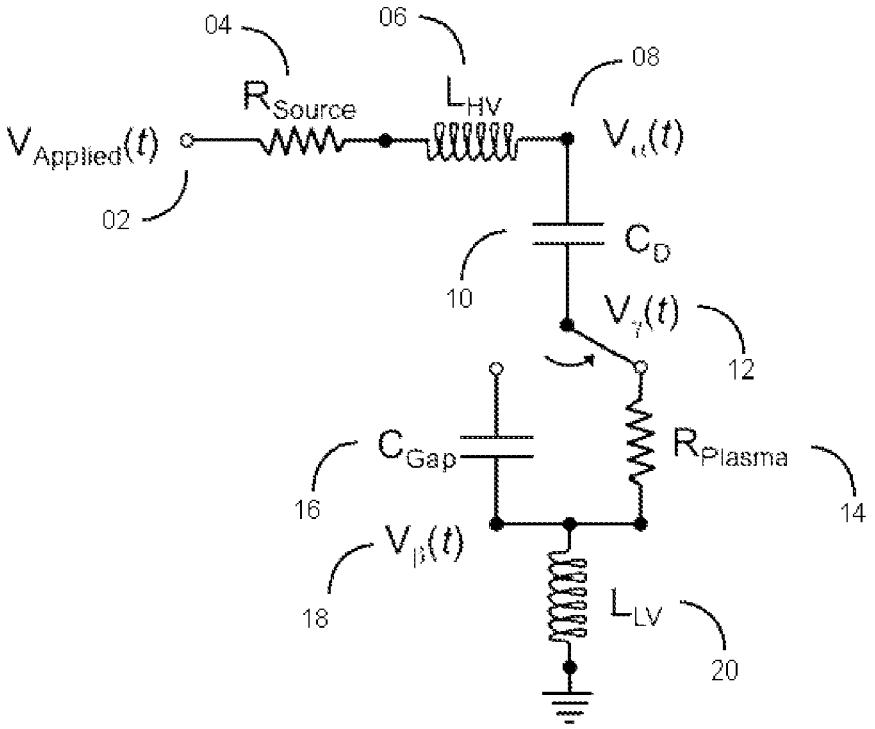
FIG. 1 is an example of a basic LRC circuit model to approximate the transient response of plasma generated in a dielectric barrier discharge consistent with certain embodiments of the present invention.

While this invention is susceptible of embodiment in many different forms, there is shown in the drawings and will herein be described in detail specific embodiments, with the understanding that the present disclosure of such embodiments is to be considered as an example of the principles and not intended to limit the invention to the specific embodiments shown and described. In the description below, like reference numerals are used to describe the same, similar or corresponding parts in the several views of the drawings.

The terms "a" or "an", as used herein, are defined as one or more than one. The term "plurality", as used herein, is defined as two or more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "one embodiment", "certain embodiments", "an embodiment", "an example", "an implementation" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means "any of the following: A; B; C; A and B; A and C; B and C; A, B and C". An exception to this definition will occur only when a combination of elements, functions, steps or acts are in some way inherently mutually exclusive.

It is noted that the disclosure below presents the best theories (interspersed with descriptions of experiments, methods and apparatus) known to the inventors at the present to explain the phenomenon observed in the plasma generating system and methods disclosed and claimed herein. However, those skilled in the art will appreciate that experimental plasma physics is often difficult to understand and explain and often contradictory explanations exist. So, while the present discussion attempts to explain both observed results and theory, it is not intended that the present invention be bound or limited by any theory discussed below in any way.

As previously noted, atmospheric pressure dielectric barrier discharges are most often energetically weak, generating maximum power densities on the order of a few watts per square centimeter per pulse cycle. What is needed is a method of generating a diffuse plasma discharge between two electrodes for any gas load. If greater power densities could be realized, the exposure time for most applications could be significantly shortened and new applications developed utilizing the improved plasma energies to overcome higher activation barriers in chemical processes. Methods for increasing the duration of a given cycle as well as increasing the cycle frequency without lowering the power density are also desirable.

Accordingly, the present subject matter provides for a method of generating a self-tuned plasma capable of maximizing power delivered to a plasma region and capable of producing a glow-like discharge in any gaseous or semi-gaseous medium. In this method, the plasma can be generated in a manner such that it self-tunes itself to produce the maximum peak power possible from the electrode arrangement and voltage source.

For convenience of the reader, reference numbers used in the specification and drawings and a description of what they describe are listed in the table below.

| Number | Description |
|---|---|
| 02 | high voltage power source input node |
| 04 | total circuit resistance of power source and all transmission lines |
| 06 | total circuit inductance of power source and high voltage transmission lines |
| 08 | measure of applied high voltage |
| 10 | capacitance of dielectric barrier |
| 12 | measure of gap voltage |
| 14 | resistance of plasma discharge |
| 16 | capacitance of electrode gap with no plasma |
| 18 | measure of voltage on ground side electrode |
| 20 | total circuit inductance of low voltage transmission lines |
| 22 | underdamped regime, oscillatory gap voltages |
| 24 | overdamped regime, non-oscillatory gap voltages |
| 26 | critically damped condition |
| 28 | plasma matching condition |
| 30 | expected current waveform based on LCR circuit model |
| 32 | experimentally observed current waveform |
| 34 | maximum of current waveform |
| 40 | step voltage waveform from generating source |
| 42 | voltage across dielectric capacitor |
| 44 | voltage across generating source internal resistance |
| 46 | voltage across plasma region in electrode gap |
| 48 | voltage across generating source inductance and HV transmission line inductance |
| 50 | voltage across low voltage transmission line inductance |
| 52 | current waveform through plasma for $L_0$ |
| 54 | current waveform through plasma for 3.2 $L_0$ |
| 56 | current waveform through plasma for 7.3 $L_0$ |
| 58 | current waveform through plasma for 29 $L_0$ |
| 60 | power supply circuit |
| 62 | electrode |
| 64 | electrode |
| 66 | dielectric |
| 68 | gap |
| 70 | high voltage transfer line |
| 72 | low voltage transfer line |

When the driving potential across two electrodes in a dielectric barrier discharge (DBD) plasma rises above the direct current (DC) breakdown potential a plasma will form. In the case where a stepped voltage input is applied the plasma will last until sufficient current passes to fully charge the dielectric barrier, $C_D V_{applied}$, where $C_D$ is the capacitance of the dielectric barrier and $V_{applied}$ is the voltage difference across the electrodes. When the dielectric is fully charged the gap potential drops to zero and the plasma terminates. In order to achieve a homogeneous discharge, a voltage source should be capable of delivering sufficient power to maintain a voltage once the plasma begins to conduct. This allows microfilaments to grow in diameter until a uniform diffuse glow-like discharge is achieved. If the voltage source does not provide such capabilities, the micro-filaments do not have proper time to grow in diameter before the voltage across the plasma falls and the discharge terminates before the diffuse glow-like discharge is achieved.

In one example embodiment, a pulsed DBD plasma discharge can be generated by driving the system with a basic voltage step function. This form of driving voltage is not a requirement to achieve self-tuning, but it provides a simple mathematical analog for illustrating the basic principles implemented to achieve matching in a plasma. The electrical operation of the plasma discharge in response to a stepped voltage input is modeled by the schematic of FIG. 1. With no driving potential a single dielectric DBD arrangement may be represented as a simple LC circuit with an inductor (L) to account for the total equivalent circuit inductance of the power generator and power delivery circuits and two capacitors representing the capacitance of the dielectric ($C_D$) and electrode gap ($C_G$) as viewed at the electrodes. When a driving voltage is applied by the power generating circuit (power generator), the voltage at the power generator ($V_{applied}$) begins to increase with time. Once the voltage across the gap ($V_g$) surpasses the DC breakdown voltage of a gas residing within the gap, the gas will eventually undergo one or more local ionization events resulting in a breakdown of the gas and thereby providing conduction paths across the gap.

In FIG. 1, high voltage power is applied as $V_{applied}(t)$ at node 02 as a function of time t. $R_{source}$ 04 represents the total circuit resistance of power source and all transmission lines. $L_{HV}$ 06 represents the total circuit inductance of power source and high voltage transmission lines. Node 08 is where the applied high voltage $V_\alpha(t)$ at the electrodes as a function of time is measured. Capacitance $C_D$ 10 is the capacitance of the dielectric barrier. $V_\lambda$ 12 is a measure of the gap voltage as a function of time t. $R_{Plasma}$ 14 is a representation of the resistive component of the plasma discharge which is generally considered for purposes of the present model to be time dependent and the impedance of the plasma is considered purely resistive, however it is in reality likely to be an impedance with inductive or capacitive components if it could be accurately measured. $C_{Gap}$ 16 is the capacitance of the electrode gap in the absence of any plasma discharge. Voltage $V_\beta(t)$ 18 is a measure of voltage on the ground side of the electrodes as a function of time. $L_{LV}$ 20 is a representation of the total circuit inductance of low voltage transmission lines to ground.

It has been discovered that at the time of plasma formation, the gap is no longer represented as a parallel plate capacitor, but rather it can be modeled as a time dependent resistance, $R_P(t)$, that depends on the dynamics of plasma spreading throughout the gap and on the subsequent formation and recombination of charge carriers as a function of time. Although it is far from clear, a priori, that this rather simple model provides a sufficiently rigorous initial physical representation of the DBD plasma, it has been found that this model representation provides remarkably close agreement to experimental observations.

Once the gap begins to conduct, the voltage difference across the dielectric increases proportionally with the current transferred through the gap and the voltage difference across the gap decreases. When the dielectric is fully charged and the potential across the gap approaches zero, the gap stops conducting current. At this point, the applied voltage can be relaxed back to zero and another pulse can be initiated. The result is that the stepped input voltage applied at node 02 produces a pulsed gap voltage, $V_g$, resulting from charge accumulation on the dielectric and the self-terminating nature of DBD plasmas.

Experimentally it is very difficult to directly measure the gap voltage as any probe attached to the gap side of the dielectric barrier interferes with the physical geometry of the DBD and as a consequence the plasma resistance cannot be directly measured. However, it is straightforward to measure the voltages at $V_\alpha(t)$ 08 and $V_\beta(t)$ 18 as a function of time along with measuring the current transmitted through the circuit. Using a basic LRC circuit model, such as the one sketched in FIG. 1, the transient response of the discharge can be approximated from $$L\frac{d^2q(t)}{dt^2} + R_{Total}(t)\frac{dq(t)}{dt} + \frac{1}{C_D}q(t) = V_{applied}(t) \quad \text{Equation 1}$$

where t is time, q(t) is the charge transfer across the gap as a function of time, L is the total equivalent inductance of the circuit, $R_{Total}(t)$ is the total equivalent circuit resistance as a function of time, $C_D$ is the capacitance of the dielectric barrier in this case but would more generally be the total equivalent capacitance of the plasma generation circuit excepting the capacitance of the power supply circuit, and $V_{applied}(t)$ is the applied voltage as a function of time. In general, the resistance of the plasma changes greatly during a discharge. Before plasma initiation, the resistance is very large and no current flows, but the resistance drops rapidly as the plasma discharge is established and in this example returns to a highly resistive state once the dielectric barrier is fully charged and the voltage across the gap approaches zero.

Despite, this strong dependence on time, it can be temporarily assumed that the resistance in the plasma region $R_{Plasma}$ 14 can be approximated by a constant during the majority of current flow. Close to the self-tuning regime, this assumption turns out to be remarkably good. The functional relationship between plasma power density and plasma resistance can be deduced from solutions of the LCR model provided in Equation 1 and plotted on a universal power curve with the dimensionless peak power of the discharge on the vertical axis and the dimensionless total circuit resistance on the horizontal axis. The resulting functional relationship is plotted in FIG. 2.

Figure 2:
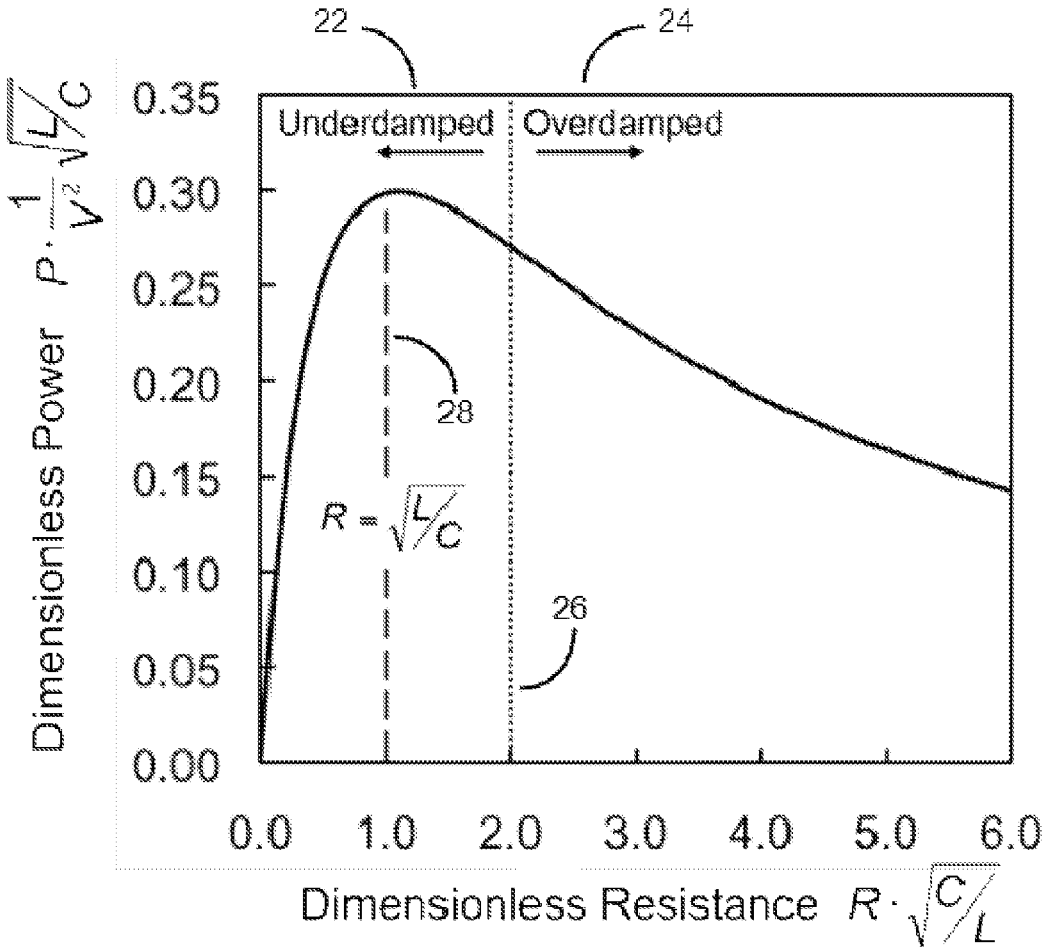
FIG. 2 is an illustration that depicts the functional relationship between plasma power density and plasma resistance deduced from solutions of an LCR model and plotted on a universal power curve with the dimensionless peak power of the discharge on the vertical axis and the dimensionless total circuit resistance on the horizontal axis consistent with certain embodiments of the present invention.

The universal power curve in FIG. 2 shows the peak power of the plasma as represented by the model of FIG. 1 and has a maximum at a dimensionless total circuit resistance value of one. The total resistance at the maximum (28) is then given by the square-root of $L/C_D$, indicating the maximum power is obtained when the plasma resistance tunes itself to match the total circuit resistance to the reactive impedance of the DBD system. The total resistance can be separated into two series resistances resulting from the plasma itself and from the generator/circuit resistance. Consequently, the total impedance of the power source and transmission lines should be smaller than the intrinsic discharge impedance defined by square-root of $L/C_D$ in order for the plasma to be able to properly tune itself to produce the maximum peak power with each discharge and not more than an order of magnitude (10×) larger than the intrinsic discharge impedance to enable a uniform discharge to occur.

When the applied voltage has the form of a stepped voltage increase, solutions to Equation 1 as a function of time reside in one of three general forms. When the dimensionless resistance is less than two, the solutions are in an underdamped regime (22) indicating that the charge will rise beyond $C_DV_{applied}$ and then oscillate one or more times around $C_DV_{applied}$ as it decays towards this steady-state value. In this oscillatory regime, the stepped voltage driving function represents an electrical impulse delivered to an LRC circuit. The observed result is that the circuit oscillates at its natural oscillation frequency, f, defined in Equation 2.

$$f = \frac{1}{2\pi}\sqrt{\frac{1}{LC} - \frac{R^2}{4L^2}} \quad \text{Equation 2}$$

In Equation 2, L and R are the equivalent inductance and resistance, respectively, of the entire plasma generation circuit including the plasma itself, and C is the equivalent capacitance of the plasma generation circuit excepting the capacitance of the power supply. In the underdamped regime of FIG. 2, the voltage and current in the gap are found to actually switch direction during the discharge. Furthermore, in the oscillatory regime, the overall plasma generation system delivers a damped, sinusoidal voltage pulse to the gap. Restated, during self-tuned operation in this embodiment using a stepped voltage increase, the plasma gases experience a pulsed sinusoidal driving voltage. This observation further demonstrates that the self-tuning mechanism applies for plasmas generated using sinusoidal voltage waveforms. When the dimensionless resistance is greater than two (24), the charge rises slowly and asymptotically approaches $C_DV_{applied}$ over increasingly longer times as the dimensionless resistance increases.

The final general solution is the critically damped regime (26) when the dimensionless resistance equals two. In this case, the charge approaches $C_DV_{applied}$ at the fastest possible rate without causing the current to switch sign. The highest power density is achieved at a dimensionless resistance of one, which resides in the oscillatory regime. FIG. 2 shows the ideal operational dimensionless resistances for maximizing the power density of the plasma lie near one and two depending upon the importance of the direction of ion or electron flow in the application.

It is noted that the above generalizations regarding the values of dimensionless resistance assume that the model of FIG. 1 is an accurate model. While this model is remarkably good, it is a simple model that can likely be refined, hence the dimensionless resistance values of one and two as discussed above are approximations that appear to be accurate within at least about 20% or better and should be considered to be such.

In order for Equation 1 to apply to a physical system, the power source should be capable of delivering adequate current to charge the dielectric sheet $C_DV_{applied}$ without causing the applied voltage to drop more than about 10-20%. If the voltage can be maintained the DBD plasma will attempt to self-tune to reach the maximum power density. While not wishing to be bound by any theory of operation, qualitatively it appears that this self-tuning occurs because if the circuit resistance is much larger than the reactance (starting on the right side of the curve), power essentially scales inversely with resistance. Therefore, increases in ionization decrease the plasma resistance and subsequently increase the overall power. This leads to further increases in ionization and the process continues until eventually the plasma reaches the point where the resistance and reactance become comparable (top of the curve). If the dimensionless resistance were to fall significantly below one, the circuit reactance would begin to dominate the resistance and power would scale proportionally with resistance. In this case a further increase in ionization produces a decrease in resistance that causes the power to actually decrease and the plasma self corrects to restore the previous ionization level. The high pressure plasmas described in this embodiment are weakly ionized gases ($n_+$, $n_- \ll n_0$ where $n_+$, $n_-$, and $n_0$ are the density per unit volume of positively charged, negatively charged, and neutral species in the gas). In general, weakly ionized gases respond to a change in power with a change in the density of carriers, $n_+$ and $n_-$, and the self-tuning mechanism applies for any weakly ionized system driven by a time-varying electrical or magnetic field regardless of whether a dielectric is present. An increase in power consumption begets more electron density in a weakly ionized plasma, which begets lower plasma resistance, which begets more power consumption, and as long as the power supply is capable of delivering sufficient power this process continues until the maximum power is achieved consistent with the universal power curve in FIG. 2.

The reactance of typical DBD plasma geometries, where reactance is defined as the square-root of $L/C_D$, is on the order of a few ohms to a few 10's of ohms (e.g., approximately between about 1 and 30 ohms), and becomes increasingly smaller as the area of the discharge increases. In order for the plasma to tune itself to deliver the maximum power density, the power source should also have a total impedance of comparable scale, and preferably lower to that of the reactance of the DBD geometry.

The lack of power sources capable of maintaining a sufficient voltage across the electrodes while delivering adequate current to sustain the discharge and simultaneously operate with a low internal impedance has left this self-tuning regime undiscovered and unutilized.

Figure 3:
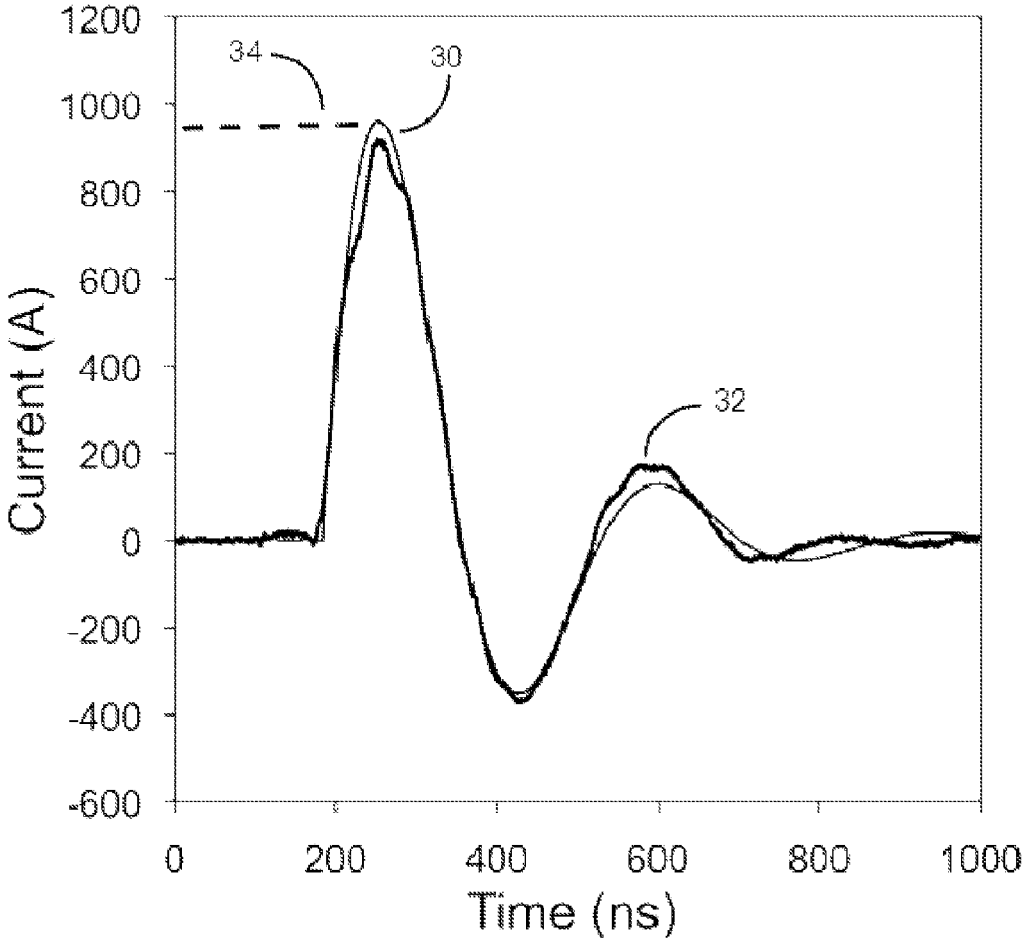
FIG. 3 is an example of an experimentally observed current for a 24 kV voltage applied across a 230 $cm^2$ set of aluminum electrodes spaced 1 mm apart in pure $N_2$ gas and separated by a 0.25 mm thick dielectric sheet of polyethylene terephthalate (PET) when a 0.12 uF capacitor bank is discharged in a manner consistent with certain embodiments of the present invention.
Figure 4A:
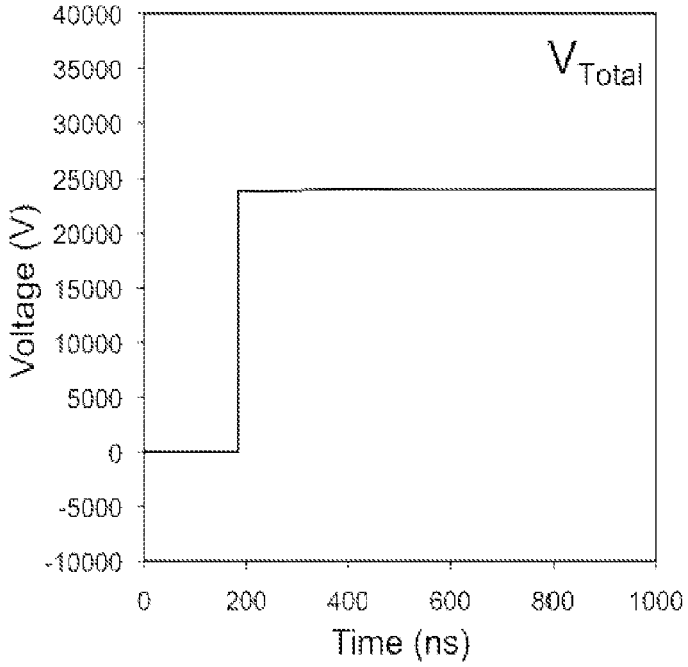
FIGS. 4A-4F is an example of voltage drops occurring across each aspect of the generating system and the plasma consistent with certain embodiments of the present invention.
Figure 4B:
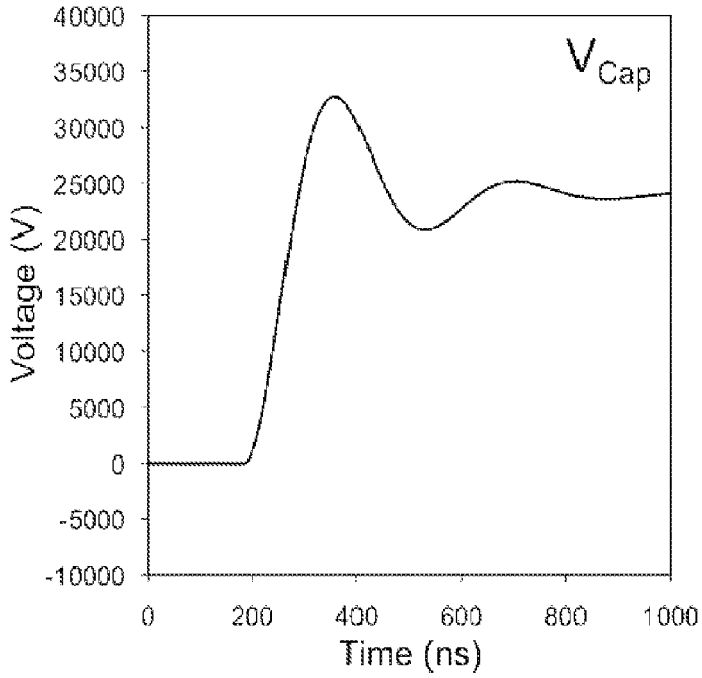
Figure 4C:
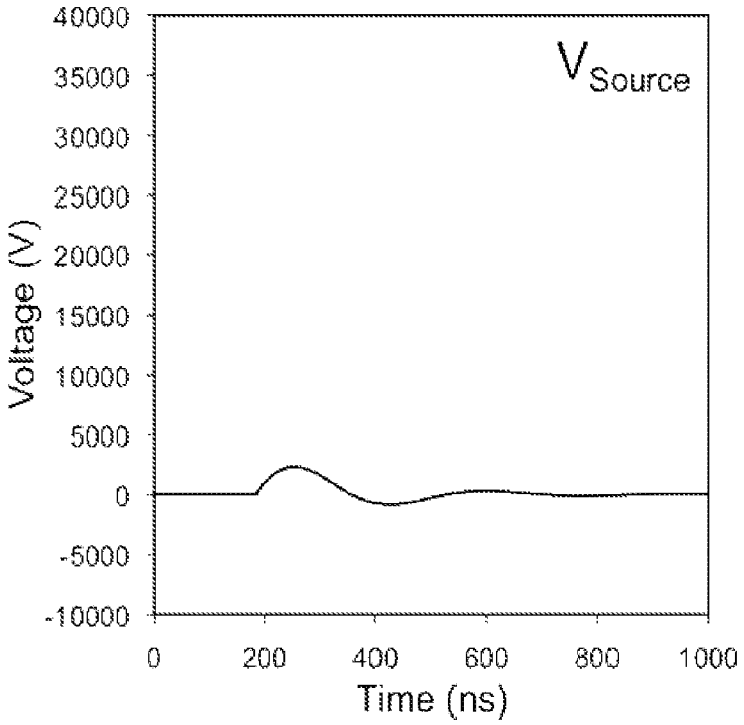
Figure 4D:
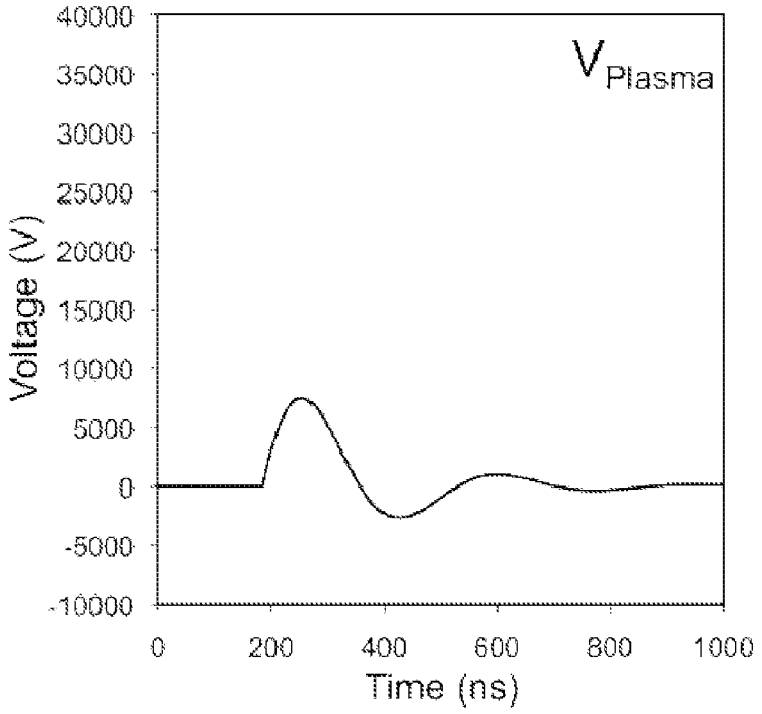
Figure 4E:
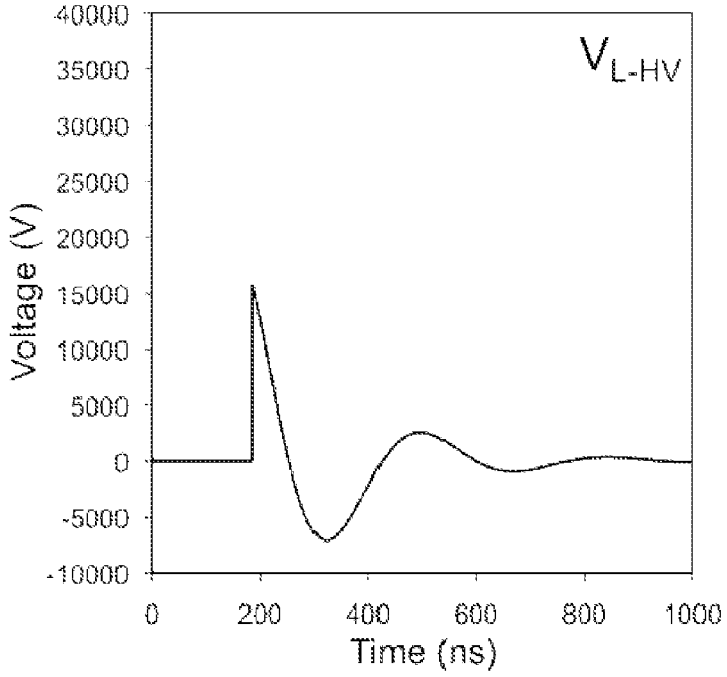
Figure 4F:
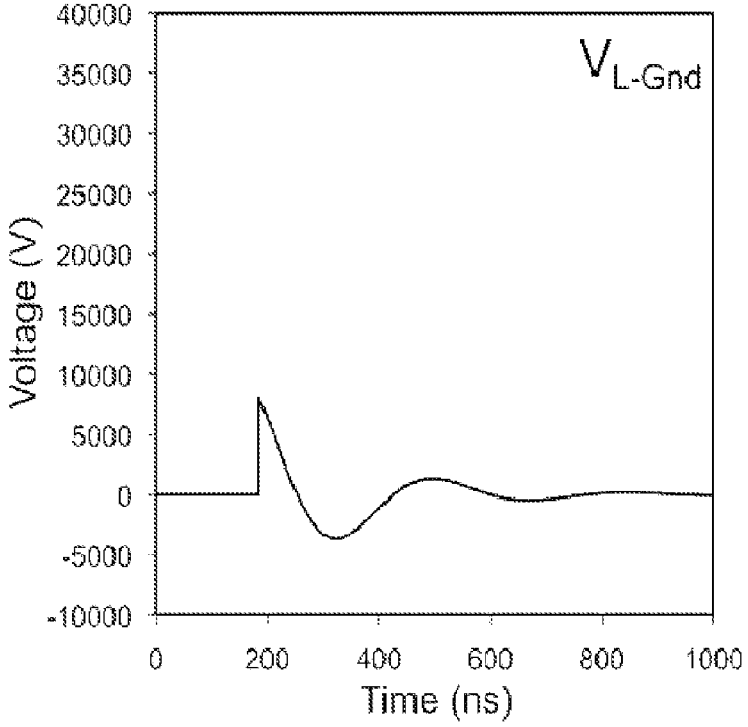

A simple example embodiment of this method to demonstrate the existence of a self-tuning DBD plasma regime can be illustrated by shorting a large high-voltage capacitor across the two electrodes, where the charge capacity of the capacitor is much larger than the charge required to fully charge the dielectric material(s) in the electrode gap. FIG. 3 contains an experimentally observed current for a 24 kV voltage applied across a 230 $cm^2$ set of aluminum electrodes spaced 1 mm apart in pure $N_2$ gas and separated by a 0.25 mm thick dielectric sheet of polyethylene terephthalate (PET) when a 0.12 microFarad capacitor bank is discharged. Peak currents approaching a kiloampere are seen with each new pulse and the duration of the induced pulses extends up to about 700 ns in duration. The total charge transferred through the plasma region is equal to the integrated area under the current trace (32) in FIG. 3 and is consistent with the charge transfer required to fully charge the PET dielectric at 24 kV. The maximum current is dependent on the total inductance in the system and can in some embodiments be kiloamperes (34) in magnitude.

Using a high-voltage capacitor having the same capacitance as the PET dielectric, the resistance and inductance of the supply circuit can be directly measured under pulse conditions. The current through the plasma can then be modeled using the LRC damped oscillator circuit with a single time-independent resistance value as the only free fit parameter. In this particular example case, a resistance value of 11.0 ohms was found to provide the agreement between Equation 1 and the experimental current. FIG. 3 also shows the current trace predicted from the embodiment described by Equation 1 when the total system resistance is fixed at 11.0 Ohms (30). This resistance is not the plasma resistance, but rather the equivalent circuit resistance seen by the sum of all resistances in the system including those from the plasma and those from the generating source. The agreement between the model and the experiment has been reproduced for a number of different gap separations and electrode areas.

The applied voltage across the plasma region is not to be confused with the applied voltage across the electrodes in a DBD system. The framework provided by Equation 1 provides a rationale for estimating the applied voltage across all of the circuit components including the plasma region. FIG. 4 shows the voltage drops calculated across each aspect of the generating system and the plasma based on the simple circuit diagram in FIG. 1 and modeled for a 1 millimeter plasma gap. The traces in FIG. 4 were calculated assuming a plasma resistance of 8.4 ohms, a generating source resistance of 2.6 ohms, a dielectric barrier capacitance of 0.003 microFarad, a high voltage inductance of 650 nanoHenry, a low voltage circuit inductance of 300 nanoHenry, and in response to a 24 kilovolt step up in driving voltage (40). The voltage across the dielectric (42) begins to rise with the onset of current flow and proceeds to rise well above the supply voltage. The voltage oscillations around the step up voltage are a result of operating in the underdamped regime. The inductance of the generating source and the high voltage transmission lines to the first electrode (48) also impact the voltage profile as a function of time as well as the transmission lines from the lower voltage second electrode (50). Changes in the overall inductance play a large role in setting the period of oscillations. The remaining components of the circuit over which voltage drops occur have to do with the resistances in the generating source (44) and in the plasma itself (46). The plasma, when ionized using a source with low internal impedance and sufficient power, will match the resistance so that the total circuit resistance is close to ideal based on FIG. 2. The total resistance of the generating source therefore impacts the resistance of the plasma generated. For the case described above where the generating source is a few ohms, the plasma resistance is about three times larger and so much more voltage is driven across the plasma gap than the components of the generating source.

A uniform plasma discharge can be maintained when the voltage across the gap at maximum current transfer is greater than about half of the DC breakdown voltage required for DC breakdown of the gaseous medium in the electrode gap. The ability to maintain a voltage that is greater than about half of the value of the DC breakdown voltage across the gap, while the gap is already conducting, allows for uniform plasma generation in DBD. In this example and for all cases studied when the voltage was maintained at or above about half the DC breakdown voltage threshold during the time of maximum current transfer, the plasma self-tuned its resistance so that experimental data relating the dimensionless power and dimensionless resistance fell in the underdamped region (dimensionless resistance $\leq 2.0$ in the ideal case, with perhaps approximately a 20% margin above the ideal of 2.0) of the universal power transmission curve (FIG. 2). Overall, best plasma performances seen experimentally in the implementations observed were obtained with a dimensionless resistance between approximately 0.5 and 2.4.

As best understood at present, in the self-tuning mode of operation, the plasma has a dominant resistance component in that any capacitive or inductive component of a model of the plasma is much smaller (approximately $<1/10$) in magnitude than the resistance component R. Thus, the plasma can be modeled as a resistor (time dependent) when operating in a self-tuned plasma. This observation is in contrast to other plasmas which have a dominant reactive—specifically capacitive or inductive—component. It is further noted that as a resistive structure, one would expect the resistance to decrease as the gap is made smaller. For gaps above about a millimeter, this behavior is observed. But surprisingly this is not the case for gaps smaller than about a millimeter. For gaps below about 1 millimeter, the effective plasma resistance increases as the gap is decreased. The observed increase in the effective plasma resistivity allows high power levels (i.e., $I^2R$) to be maintained in agreement with operation in the self-tuning regime.

This is different from what was taught by Hooke et al. in U.S. Pat. Nos. 7,615,931, 7,615,933, and 8,084,947 which are hereby incorporated by reference where a fast rise time in the applied voltage step was used to establish an overvoltage condition before breakdown. In implementation embodiments consistent with this invention the plasma is driven with a generating source capable of supplying an overvoltage at some time after the plasma has already been ionized. Operation in this regime is not limited by how the plasma is initially ionized before breakdown, and in fact the initial breakdown can be generated in any suitable manner. In certain example implementations this can have the advantage that the ionized gas in the plasma does not need to fully recombine before another pulse is applied allowing for much higher duty cycles and even the use of continuous waveforms over extended periods of time.

As best understood at present, in the self-tuning regime the total power consumed in the plasma generation circuit is related to the total equivalent impedance of the circuit which contains the plasma. The plasma itself is a circuit element with variable impedance. The characteristic of the plasma to self-tune its impedance to maximize the overall power transferred through the plasma generation as shown in FIG. 2 suggest some useful generalizations. The self-tuning relationship implies that the lower the internal impedance of the power source, the higher the resistance of the actual plasma that can be maintained and the higher the resulting power density of the plasma. As higher voltages are applied, if the gap resistance remains essentially the same, the power density increases accordingly. Similarly, when the spacing of the discharge gap is decreased and the applied voltage is held constant, the power density also increases. A shock wave may be created in the plasma by the deposition of power in a working gas over a time period shorter than the acoustic transit time in said working gas. By going to discharges with smaller and smaller gaps or higher and higher applied voltages, voltages well in excess of the DC breakdown voltage may be maintained across the plasma at peak current.

For gaps larger than about one millimeter, peak currents rise as the gap is decreased, and the power density increases markedly even though the effective plasma resistance declines as the gap is scaled down at constant voltage. Given that the resistive component of the plasma impedance seems to dominate its behavior in the self-tuning regime, the effective plasma resistance is proportional to the thickness of the resistive circuit element (i.e., the weakly-ionized gas) through which current must pass for gaps greater than about one millimeter. If this proportional relationship between the effective plasma resistance and gap spacing were maintained, then the effective plasma resistance would eventually reach a value so small for very small gaps that insufficient power would be deposited in the plasma gas and the self-tuning mechanism would be expected to fail. However, in the experiments conducted the proportional relationship fails, and self-tuning is maintained for gaps below about 1 millimeter. As the gap is reduced and the surface to volume ratio changes, many physical processes that determine the plasma properties also change, including dominant electron emission mechanisms, the electron and ion kinetics, and other factors. In practice, as the gap is reduced below about one millimeter, the effective plasma resistance begins to increase as the gap is decreased. This shift in the plasma behavior leads to the observed increase in the effective plasma resistivity for small gaps shown in FIG. 6 and allows high power levels (i.e., $I^2R$) to be maintained in agreement with operation in the self-tuning regime.

Figure 6:
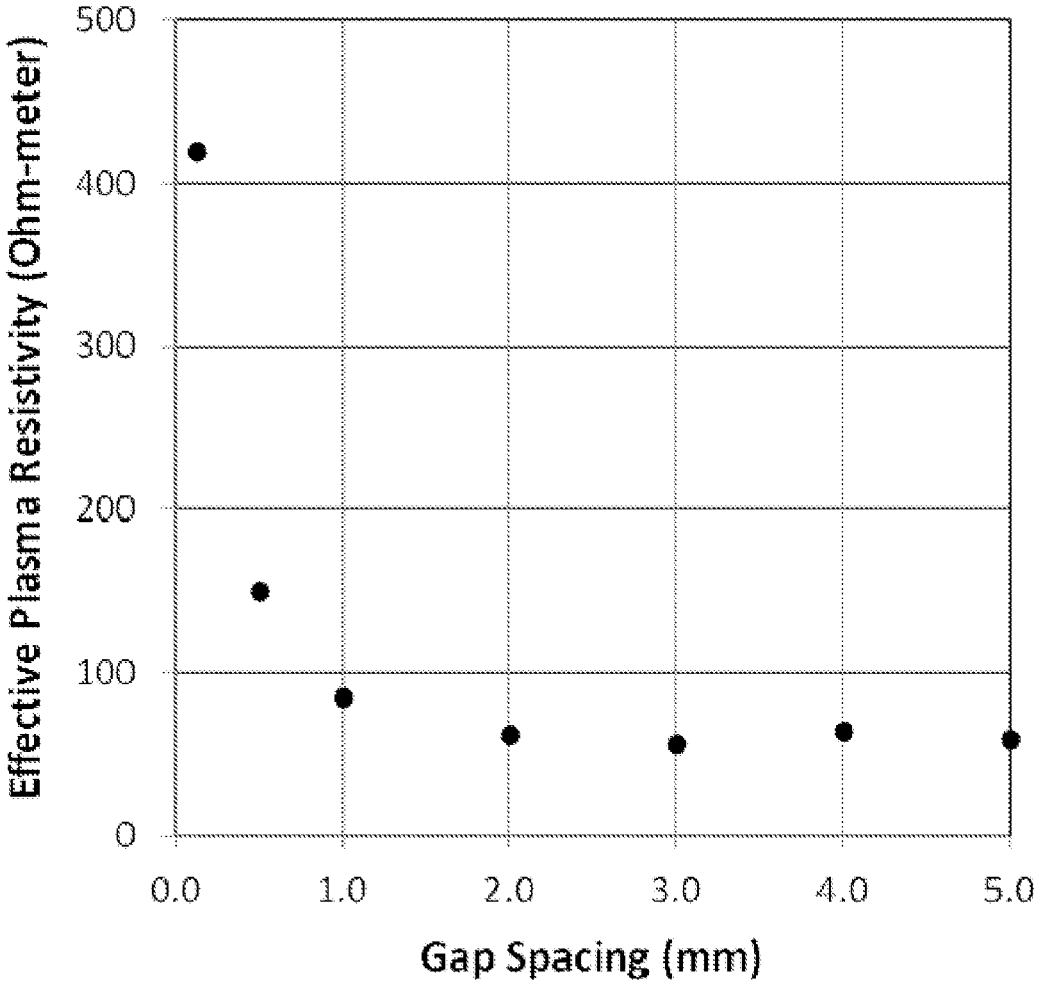
FIG. 6 is a plot of effective plasma resistivity values for experiments performed in the self-tuned plasma regime at a range of electrode gaps in a manner consistent with implementations of the present invention.

Referring to FIG. 6, the effective plasma resistivity values for experiments performed in the self-tuned plasma regime at a range of electrode gaps is shown. The voltage supply circuit comprised timing circuits, a capacitor bank, and a gas switch to deliver a stepped DC voltage increase of 24 kilovolts. The capacitor bank had a total capacitance of 0.12 microFarads, and the dielectric barrier capacitance was 0.3 nanoFarads. The effective resistivity is approximately constant as the gap is reduced from 5.0 to about 1.0 millimeters. The effective plasma resistivity increases markedly at gaps below about 1.0 millimeter. In these experiments, the effective resistance varied in a range of about 20 to 80 ohms while the dimensionless resistance was within the oscillatory regime and ranged from about 0.5 to 2.0 with dimensionless power values in agreement with FIG. 2. The effective resistivity increased for gaps below 1 millimeter to maintain self-tuned operation. It is noted that above 1 mm, an increase in power apparently leads to an increase in the carrier density and a lower resistance. But, above about 1 mm, larger gaps have larger resistance values. Below 1 mm, smaller gaps have larger resistance, and dividing things out shows that the resistivity is increasing rapidly but the points still fall on the universal curve. Note that this increase in resistance for small gaps contradicts the qualitative explanation of how the tuning works for larger gaps as discussed above. Hence, there is an unexplained phenomenon occurring for small gaps.

It has been verified experimentally that this self-tuning mechanism holds for gaps down to at least 125 microns, and it is expected that self-tuning can be achieved at significantly smaller gaps. At conditions approaching about three times the DC breakdown voltage and greater, the energies should generally be sufficient to produce runaway electrons within the plasma which may be used to produce x-rays.

It is further noted that additional set(s) of electrodes can be placed in series or parallel and passive components such as resistors, inductors, or capacitors can be placed in series or parallel with the electrode gap to control the total width, amplitude, or decay of the discharge current in order to provide further control of the discharge characteristics. In addition, adding circuit components as described while operating in a self-tuning regime provides a method of tuning the load impedance, $R_{plasma}$ in the example embodiment, to a desired value.

Figure 5:
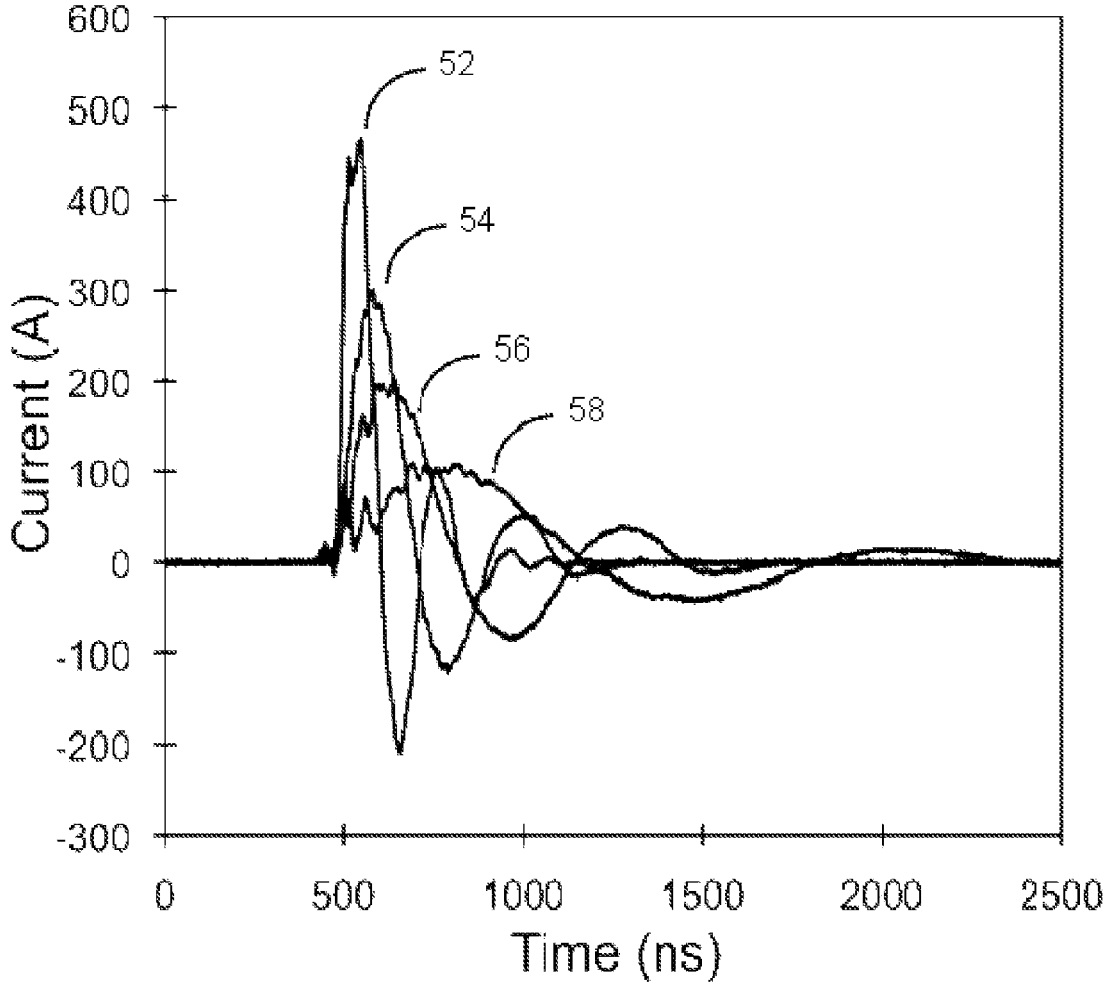
FIG. 5 is an example of changes that can be expected theoretically by increasing the inductance of the circuit in comparison to those that have been actually been brought to practice consistent with certain embodiments of the present invention.

When a DBD plasma is operated in a self-tuning mode, additional tunability to the plasma becomes possible while maintaining the same generating efficiency. In another example embodiment, the addition/subtraction of different inductors or modification of the transmission line inductances, makes it possible to generate plasmas with different pulse lengths while maintaining the same dimensionless resistance. FIG. 5 shows the changes to the current going through the plasma in the self-tuning regime by changing the inductance of the circuit. The lowest inductance trace (52) shows a higher current and shorter periodicity than the other traces. When the initial transmission line inductance, $L_0$, is increased by a factor of 3.2 (54), the circuit resistance is found to increase by a factor of approximately 1.7. The self-tuning relationship from FIG. 2 would have predicted the resistance would increase by the square-root of the inductance ratio ($3.2 \cdot L_0/L_0$) or approximately 1.8. Increasing the inductance by factors of 7.3 and 29 produce even longer period current traces (56 and 58) and produces increases in the plasma resistance by factors of 2.4 and 4.8, again as expected if the plasma is self-tuning.

Similarly, additional resistances can also be added to the lines to lower the actual plasma power density, if needed in a given application. However, it is generally preferred to keep the circuit resistance as low as possible to maximize the plasma power density.

The voltage applied across the gap does not have to be constant as provided for in the previously described embodiments. One aspect of the plasma in certain implementations is the fact that even when a step voltage is applied, the voltage across the plasma is not constant, and can in fact oscillate (46). Any driving potential can be used provided a voltage drop across the plasma exceeds about half the DC breakdown voltage for the gaseous region at the time when peak current is achieved in order to establish self-tuning. A discharge utilizing a low impedance switch, such as a gas switch like a thyratron, spark gap, or related plasma switching device, or solid-state devices utilizing insulator gate bipolar transistors (IGBT's) or thyristors to provide switching as described by Hooke et al. in U.S. Pat. Nos. 7,615,931 and 7,615,933 would suffice in the simplest embodiments as long as they were equipped with sufficient capacitance to maintain the stepped voltage at the current required by the self-tuned plasma. Gas switches such as a spark gap have the advantage in some implementations for large power systems that the resistance of the switch decreases as the current through them increases; however pulse frequency is limited in the switches due to their recovery time. The impedance of the switch is desired to be less than the plasma impedance to allow for the maximum plasma resistance and power density, but the total charge that can be delivered by the power generator circuit should ideally be many times larger than the capacitance of the dielectric barrier(s) in the electrode gap (e.g., at least 2 times greater and preferably at least 5-10 times greater) and in any case large enough to deliver the electric field to the gap as described herein so as to maintain the discharge and permit self-tuning.

Another embodiment of the self-tuning generation method is to use a high power radio-frequency (RF) pulsed driver. The source should have sufficient power such that at the point current flows through the plasma, the supply is able to maintain a voltage drop across the plasma that is greater than about half the DC breakdown voltage for the gaseous region at the time when peak current occurs. The total power required will depend on the area of the electrodes and on the magnitude of the voltage used to provide breakdown. With an RF driver operating on a series LRC circuit at resonance the entire applied voltage appears across the R since at resonance the voltage drops across L and C are equal in magnitude and opposite in sign.

Pulsed radio frequency (RF) driving sources for the self-tuning plasma generation can have several advantages in certain implementations in that they can be tuned to the natural underdamped oscillation frequency of the pulsed discharge and they also can make use of the memory charge that lies on the dielectric barrier(s) following discharge. During a dielectric barrier discharge, the applied voltage is typically brought back to zero sometime after the discharge is complete. The dielectric discharges some of its accumulated charge back into the circuit, but a voltage remains on the dielectric(s) approximately equal to the DC breakdown voltage. This voltage reduces the effective gap voltage by subtracting from the applied voltage during subsequent pulses. In certain example implementations, an advantage of an RF source is that by oscillating the applied voltage through zero, the memory charge adds to the applied voltage and lower overall magnitudes of the applied voltage are required to achieve the same charge transfer. Due to the relatively high power used to reach a self-tuning mode when an RF source is used, the RF may be pulsed/truncated or significant cooling of the electrodes used to absorb the output energy. Pulsed RF enables the plasma to run very much like a pulsed system initially, but with an additional RF train allowing control over the duty cycle and overall power delivery. Traditionally, RF has had the disadvantage of relatively high internal impedance; however, if sufficient power can be delivered to maintain the driving voltage, the resistance of the plasma will strive to continuously match the impedance of the plasma system determined by the square-root of the ratio of system inductance divided by the equivalent capacitance of the system and dielectric used to spread the space charge in the plasma region. Additionally, a generating source with lower internal impedance would produce more powerful plasmas.

When an RF source is connected to a load R through a transmission line of impedance Z, the relationship of power transmitted to the load, R, as a function of R looks similar to FIG. 2 with a broad maximum at R=Z. Matching networks can be employed to maintain the resonance and matching conditions of the circuit to the load. Self-tuning can help maintain the matching conditions for an RF-driven plasma even when using a matching network.

In another embodiment it is possible to match to a wider range of periodic driving functions beyond sinusoids. For example, using push/pull square waves, sawtooth patterns, or other arbitrary waveforms. Normally, matching to such functions would be difficult, but under the conditions of self-tuning, the resistance of the plasma load changes to match with the driving function. Self-tuning has been demonstrated with a step function, which is an obviously non-sinusoidal driving waveform. Any arbitrarily shaped drive voltage where the voltage across the gap is brought to a value greater than about half the DC breakdown voltage following the establishment of a conducting plasma can be used including step functions as in the examples already mentioned and continuous waves whether they are sinusoidal as in RF discharges, or triangular, or simply a series of step functions of varying amplitudes. It is noted that the value of about half the DC breakdown voltage is an estimate that can be verified experimentally for a given implementation using various sources.

In another embodiment, the applied voltage could be generated using a master oscillator power amplification (MOPA) architecture in which a master oscillator is used to generate the voltage waveform and a power amplifier acts on the oscillator output to generate a high power voltage waveform of arbitrary shape. The amplifier could be used as reservoir of energy that is extracted during a given pulse. Possible deformation of the temporal pulse shape due to the extracted energy could be tuned by the plasma, or the initial waveform could be tailored to provide the desired pulse shape after amplification.

Applications that would benefit from the employment of a self-tuning DBD plasma generation method include, but are by no means limited to some of the following: The functionalization of surfaces through plasma gas chemistry. Surface functionalization can be accomplished by grafting of plasma-activated gas-phase chemicals onto the surface, by modifying or removing chemical groups on the material surfaces, or by a mixture of plasma enhanced reactions in both the gas-phase and on the surface. The gas-phase may contain solid or liquid aerosols to bond small clusters, nanoparticles, or macroscopic particles of atomic or molecular species and/or high molecular-weight chemicals to the surface. Overall, plasma-enhanced functionalization can impart a range of properties including making a surface more hydrophobic/oleophobic or more hydrophilic/oleophilic and also including specialized optical, electrical, magnetic, and/or biological properties depending on the nature of the reacted species. Series of reactions can be performed using multiple reactants and/or solid or liquid aerosols to generate complex surfaces in which the chemical nature and/or surface morphology lead to a desired effect(s). One example is the generation of a non-fouling, anti-bacterial filter by functionalization of nanodiamond particles with germicidal chemical groups followed by deposition of the functionalized nanodiamond particles to generate a hierarchically ordered morphology on the filter surface. The adhesion of materials can be enhanced by treatment or functionalization of the surface of one or both of the materials before bringing them into contact, and the properties of the final multilayer material may be improved by the increased interlayer adhesion or by plasma deposition of a thin film on top of or between the bonded layers. The deposition of materials and coatings may be enabled due to chemical reactions within the ionized gas(es). The plasmas may be used for etching or removal of surface coatings or functionalization. They may be used to enhance abatement processes in gas streams, for defouling purposes, or for the production of synthetic gases. Applications involving roll-to-roll treatment of webs, films, or sheets composed of polymers, fabrics, textiles, and/or inorganic materials benefit from plasma operation using the self-tuning method because the high densities of active species generated in the plasma enable faster processing speeds than when a lower power, traditional plasma is used. The electrons, gas chemistry, ultraviolet (UV) radiation, or photons generated by the discharge can also be used for sterilization purposes. The plasmas may be used for active flow control for both fixed wing and rotary blade aircraft reducing drag and increasing lift. Plasmas may be used to minimize unwanted sound vibrations and noise. The self-tuning plasma generation method can essentially be used in any application currently making use of atmospheric pressure plasma technologies but employing much higher power densities.

The plasma may be used to generate a flux of chemical species, ions, or electrons, and electromagnetic radiation. The flux of plasma-generated species can be increased or controlled using the described technology. Such species may be directed towards substances in various ways including by action of gas flow or by action of electric or magnetic fields and may be extracted either through free space or through film(s) or foil(s) of material into a zone having a higher or lower pressure than the original plasma pressure. For example, this technology can enable a plasma-based electron source to be produced when the plasma is operated in the self-tuning regime. In general, runaway electrons are defined as having very low collision cross-sections that allow them to undergo continuous acceleration in an electric field. A detectable number are generated above a critical field, $E_{cr}$, to gas number density, $n_0$, ratio ($E_{cr,1}/n_0$), and all electrons generated undergo continuous acceleration above a second, higher critical field to gas number density ratio ($E_{cr,2}/n_0$). The magnitude of the critical field required depends on the identity of the gas treated. When plasma is formed in the self-tuning regime, the high power density can increase the number of runaway electrons available and extend the useful pressure range of operation of a plasma-based electron source. Operation in both the self-tuning regime and in the regime where all electrons are runaway electrons (i.e., $E_{applied}/n_0 > E_{cr,2}/n_0$) would provide an additional performance increase. Other applications that would benefit from a source providing a tunable flux of electrons include electron sources, plasma-based electronic devices, and x-ray generators. In addition, applications that would benefit from a tunable flux of active, plasma-generated species include deposition, surface modification, and chemical reactions at a range of pressures.

The geometry of the electrodes can be any geometry such that there are two electrodes separated by at least one dielectric material sufficient to spread the space charge and prevent the formation of arcs. Acceptable geometries include, but are not limited by, planar, curved, conical, and cylindrical geometries.

The self-tuning mode applies to all gases and covers a wide range of pressures and temperatures. The change in pressure affects the DC breakdown voltage and consequently the magnitude of the applied voltage for each gas or gas mixture. The operational temperature impacts the molecular density of the gas or gas mixture, which similarly affects the DC breakdown voltage and consequently the magnitude of the applied voltage for each gas or gas mixture, but does not change the general requirements for self-tuning. The self-tuning method applies to plasmas in which the plasma gases are weakly ionized.

Hence, a method of generating self-tuning plasma has been developed that attempts to match the natural matching impedance of the plasma circuit determined by the square-root of the ratio of system inductance divided by the equivalent capacitance of the system and dielectric used to spread the space charge in the plasma region. The method also uses a power source capable of generating an electric field across the plasma region that is greater than about half of the direct current breakdown threshold electric field of the supply gas at the time current transfer is near a maximum. The method also uses a power source that has a total impedance of comparable scale to, and preferably lower than, the reactance of the plasma geometry in order to deliver the maximum power density.

It is noted that the plasma discharge can be maintained with an electric field across the gap that is greater than about half the direct current breakdown threshold voltage of the gas at the time current transfer is at a maximum, but the plasma discharge can also be initiated in any suitable manner and maintained in the self-tuned mode using the teachings herein in order to maintain the plasma discharge using the self-tuning principles taught herein.

Figure 7:
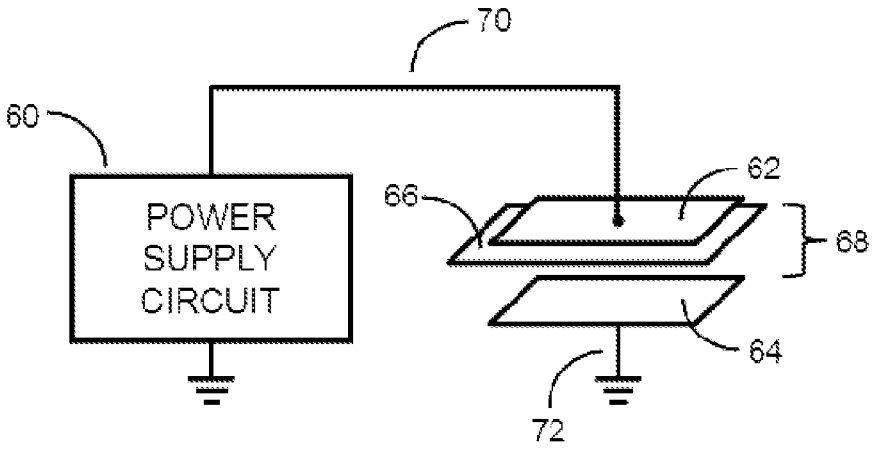
FIG. 7 is an example block diagram of a plasma generating system consistent with certain implementations of the present invention.

Referring now to FIG. 7, a basic circuit is depicted for a plasma generation system consistent with certain implementations. In this example, power supply 60 operates as described above. The power supply is coupled to a pair of electrodes 62 and 64 separated by a gap 68. The gap 68, for the case of a dielectric barrier discharge system, also has a dielectric barrier 66 disposed therein. Depending upon the mode of operation of the system the power supply transfers power along line 70 to a common ground through line 72. In the case where the power supply circuit operates as an RF source, lines 70 and 72 behave in the manner of a transmission line. The power supply operates in the manner described above in that it initiates a plasma discharge in the gas within the electrode gap and maintains a sufficient electric field across the gap during the plasma discharge to allow a plasma impedance to self-tune to the plasma generating system. Stated in another manner, the power supply generates an electric field across the plasma region that approaches or exceeds the direct current breakdown threshold of the supply gas at the time current transfer is near a maximum, and is further capable of transferring sufficient power to the gap region during the discharge to allow the resistance of the plasma to self-tune and approach the natural impedance of the power generating circuit. While the experiments to date have always utilized a dielectric barrier 66, it is believed possible to utilize a similar structure to generate a similar discharge without the barrier, but this is not intended to be limiting in any manner. In experimental implementations, the gap is between approximately five centimeters and approximately 125 microns in distance, excluding a thickness of the one or more dielectrics. It is expected that even smaller gaps below 125 microns are possible within the range below 1000 microns.

Thus, as explained above, a method of generating a plasma discharge in a gas involves providing a plasma generating system comprising a pair of electrodes spaced apart by an electrode gap with a dielectric disposed in the electrode gap and with the electrodes being driven by a power generating circuit; allowing the gas to enter the electrode gap; initiating a plasma discharge in the gas within the electrode gap; and maintaining a sufficient electric field across the gap during the plasma discharge to allow a plasma impedance to self-tune to the plasma generating system.

In certain implementations, the maintaining comprises generating the electric field across the gap that is greater than about half of the direct current breakdown threshold electric field of the gas at the time current transfer is at a maximum. In certain implementations, the maintaining comprises generating an adequate electric field across the plasma region to maintain the plasma at the time current transfer is at a maximum. In certain implementations, the impedance of the plasma generating system has an impedance determined by a square root of a ratio of system inductance divided by an equivalent capacitance of the system and dielectric used to spread the space charge in the plasma within the gap. In certain implementations, the power generating circuit has a total impedance that is approximately equal to or less than a reactance of the dielectric in combination with the electrodes. In certain implementations, the gas contains liquid and/or solid aerosols. In certain implementations, runaway electrons are generated in the plasma. In certain implementations, the gap is between approximately one centimeter and approximately 125 microns in distance, excluding a thickness of the one or more dielectrics. In certain implementations, the power source provides a pulsed radio frequency driving voltage to establish the electric field across the gap. In certain implementations, one or more sets of electrodes and dielectric barriers, one or more resistors, inductors, or capacitors are in series or parallel with the electrode gap to control a total width, amplitude, or decay of the current between the electrodes. In certain implementations, the runaway electrons have sufficient energy to produce x-rays. In certain implementations, a shock wave is created in the plasma by the deposition of power in the gas over a time period shorter than the acoustic transit time in the gas. In certain implementations, the plasma impedance in combination with the impedance of the plasma generating system can be represented as a dimensionless resistance value of approximately 1.0. In certain implementations, the plasma impedance in combination with the impedance of the plasma generating system can be represented as a dimensionless resistance value of less than or equal to approximately 2.4.

Another method of generating a plasma discharge in a gas involves providing a plasma generating system comprising a pair of electrodes spaced apart by an electrode gap with a dielectric disposed in the electrode gap and with the electrodes being driven by a power generating circuit; allowing the gas to enter the electrode gap; initiating a plasma discharge in the gas within the electrode gap by generating an electric field across the plasma region that is adequate to establish the plasma discharge; and maintaining sufficient power in the gap during the plasma discharge to allow a plasma impedance to self-tune to the plasma generating system by maintaining the electric field at a level that is approximately equal to or greater than about half the direct current breakdown threshold electric field of the gas at a time when current transfer is near a maximum, where the plasma impedance in combination with the impedance of the plasma generating system can be represented as a dimensionless resistance value of less than or equal to approximately 2.4.

A plasma generating system has a pair of electrodes spaced apart by an electrode gap and having one or more dielectrics disposed in the electrode gap. A source of a gas is adapted to place the gas in the electrode gap. A power generating circuit is coupled to the electrodes to generate an electric field across the electrodes so as to initiate a plasma discharge within the electrode gap. The power generating circuit has adequate capacity to maintain a sufficient electric field across the gap during the plasma discharge to allow a plasma impedance to self-tune to the plasma generating system.

In certain implementations, the maintaining comprises generating the electric field across the gap that is greater than or equal to half the direct current breakdown threshold electric field of the gas at the time current transfer is at a maximum. In certain implementations, the maintaining comprises generating an adequate electric field across the gap to maintain the plasma at the time current transfer is at a maximum. In certain implementations, the gas contains liquid or solid aerosols. In certain implementations, runaway electrons are generated in the plasma. In certain implementations, the gap is between approximately one centimeter and approximately 125 micrometers, excluding a thickness of the one or more dielectrics. In certain implementations, the power generating circuit provides a pulsed radio frequency driving voltage to establish the electric field across the gap. In certain implementations, one or more sets of electrodes and dielectrics, one or more resistors, inductors, or capacitors in series or parallel with the electrode gap to control a total width, amplitude, or decay of the current between the electrodes. In certain implementations, where runaway electrons are produced in the plasma where the runaway electrons have sufficient energy to produce x-rays. In certain implementations, a shock wave is created in the plasma by the deposition of power in the gas over a time period shorter than the acoustic transit time in the gas. In certain implementations, the plasma impedance in combination with the impedance of the plasma generating system has a dimensionless resistance value of approximately 1.0. In certain implementations, the plasma impedance in combination with the impedance of the plasma generating system has a dimensionless resistance value of less than or equal to approximately 2.4.

Another method of generating a plasma discharge in a gas involves providing a plasma generating system comprising a pair of electrodes spaced apart by an electrode gap of less than about 1000 microns with the electrodes being driven by a power generating circuit; allowing the gas to enter the electrode gap; initiating a plasma discharge in the gas within the electrode gap where the plasma has a dominant resistive component; and maintaining a sufficient electric field across the gap during the plasma discharge to allow the plasma resistance to self-tune to the plasma generating system.

In certain implementations, a dielectric is disposed in the electrode gap. In certain implementations, the maintaining comprises generating an adequate electric field across the plasma region to maintain the plasma at the time current transfer is at a maximum. In certain implementations, the power source provides a pulsed radio frequency driving voltage to establish the electric field across the gap. In certain implementations, runaway electrons are generated and where the runaway electrons have sufficient energy to produce x-rays.

While certain illustrative embodiments have been described, it is evident that many alternatives, modifications, permutations and variations will become apparent to those skilled in the art in light of the foregoing description.

What is claimed is:

1. A method of generating a plasma discharge in a gas, the method comprising:

providing a plasma generating system comprising a pair of electrodes spaced apart by an electrode gap with a dielectric disposed in the electrode gap and with the electrodes being driven by a power generating circuit;

allowing the gas to enter the electrode gap;

initiating a plasma discharge in the gas within the electrode gap;

maintaining a sufficient electric field across the gap during the plasma discharge to allow a plasma impedance to self-tune to the plasma generating system; and where the maintaining comprises generating an adequate electric field across the plasma region to maintain the plasma at the time current transfer is at a maximum.

2. The method according to claim 1, where the maintaining comprises generating the electric field across the gap that is greater than about half of the direct current breakdown threshold electric field of the gas at the time current transfer is at a maximum.

3. The method according to claim 1, where the impedance of the plasma generating system has an impedance determined by a square root of a ratio of system inductance divided by an equivalent capacitance of the system and dielectric used to spread the space charge in the plasma within the gap.

4. The method according to claim 1, where the power generating circuit has a total impedance that is approximately equal to or less than a reactance of the dielectric in combination with the electrodes.

5. The method according to claim 1, where the gas contains liquid and/or solid aerosols.

6. The method according to claim 1, where runaway electrons are generated in the plasma.

7. The method according to claim 1, where the gap is between approximately one centimeter and approximately 125 microns in distance, excluding a thickness of the one or more dielectrics.

8. The method according to claim 1, where the power source provides a pulsed radio frequency driving voltage to establish the electric field across the gap.

9. The method according to claim 1, where one or more sets of electrodes and dielectric barriers, one or more resistors, inductors, or capacitors are in series or parallel with the electrode gap to control a total width, amplitude, or decay of the current between the electrodes.

10. The method according to claim 1, where runaway electrons are produced in the plasma and the runaway electrons have sufficient energy to produce x-rays.

11. The method according to claim 1, where a shock wave is created in the plasma by the deposition of power in the gas over a time period shorter than the acoustic transit time in the gas.

12. The method according to claim 1, where the plasma impedance in combination with the impedance of the plasma generating system can be represented as a dimensionless resistance value of approximately 1.0.

13. The method according to claim 1, where the plasma impedance in combination with the impedance of the plasma generating system can be represented as a dimensionless resistance value of less than or equal to approximately 2.4.

14. A method of generating a plasma discharge in a gas, the method comprising:

providing a plasma generating system comprising a pair of electrodes spaced apart by an electrode gap with a dielectric disposed in the electrode gap and with the electrodes being driven by a power generating circuit;

allowing the gas to enter the electrode gap;

initiating a plasma discharge in the gas within the electrode gap by generating an electric field across the plasma region that is adequate to establish the plasma discharge; and maintaining sufficient power in the gap during the plasma discharge to allow a plasma impedance to self-tune to the plasma generating system by maintaining the electric field at a level that is approximately equal to or greater than about half the direct current breakdown threshold electric field of the gas at a time when current transfer is near a maximum, where the plasma impedance in combination with the impedance of the plasma generating system can be represented as a dimensionless resistance value of less than or equal to 2.4.

15. A plasma generating system, comprising:

a pair of electrodes spaced apart by an electrode gap and having one or more dielectrics disposed in the electrode gap;

a source of a gas adapted to place the gas in the electrode gap;

a power generating circuit coupled to the electrodes to generate an electric field across the electrodes so as to initiate a plasma discharge within the electrode gap;

where the power generating circuit has adequate capacity to maintain a sufficient electric field across the gap during the plasma discharge to allow a plasma impedance to self-tune to the plasma generating system; and where the electric field across the gap is adequate to maintain the plasma at the time current transfer is at a maximum.

16. The plasma generating system according to claim 15, where the electric field across the gap is greater than or equal to half the direct current breakdown threshold electric field of the gas at the time current transfer is at a maximum.

17. The plasma generating system according to claim 15, where the gas contains liquid or solid aerosols.

18. The plasma generating system according to claim 15, where runaway electrons are generated in the plasma.

19. The plasma generating system according to claim 15, where the gap is between approximately one centimeter and approximately 125 micrometers, excluding a thickness of the one or more dielectrics.

20. The plasma generating system according to claim 15, where the power generating circuit provides a pulsed radio frequency driving voltage to establish the electric field across the gap.

21. The plasma generating system according to claim 15, further comprising one or more sets of electrodes and dielectrics, one or more resistors, inductors, or capacitors in series or parallel with the electrode gap to control a total width, amplitude, or decay of the current between the electrodes.

22. The plasma generating system according to claim 15, where runaway electrons are produced in the plasma and the runaway electrons have sufficient energy to produce x-rays.

23. The plasma generating system according to claim 15, where a shock wave is created in the plasma by the deposition of power in the gas over a time period shorter than the acoustic transit time in the gas.

24. The plasma generating system according to claim 15, where the plasma impedance in combination with the impedance of the plasma generating system has a dimensionless resistance value of approximately 1.0.

25. The plasma generating system according to claim 15, where the plasma impedance in combination with the impedance of the plasma generating system has a dimensionless resistance value of less than or equal to approximately 2.4.

26. A method of generating a plasma discharge in a gas, the method comprising:

providing a plasma generating system comprising a pair of electrodes spaced apart by an electrode gap of less than about 1000 microns with the electrodes being driven by a power generating circuit;

where a dielectric is disposed in the electrode gap and the electrode gap excludes the dielectric;

allowing the gas to enter the electrode gap;

initiating a plasma discharge in the gas within the electrode gap where the plasma has a dominant resistive component;

maintaining a sufficient electric field across the gap during the plasma discharge to allow the plasma resistance to self-tune to the plasma generating system; and where the maintaining comprises generating an adequate electric field across the plasma region to maintain the plasma at the time current transfer is at a maximum.

27. The method according to claim 26, where the power source provides a pulsed radio frequency driving voltage to establish the electric field across the gap.

28. The method according to claim 26, where runaway electrons are generated and where the runaway electrons have sufficient energy to produce x-rays.

* * * * *